US009474931B2

(12) United States Patent
Alldredge

(10) Patent No.: US 9,474,931 B2
(45) Date of Patent: Oct. 25, 2016

(54) THUMB EXERCISE DEVICE

(71) Applicant: Rodney H. Alldredge, Peachtree Corners, GA (US)

(72) Inventor: Rodney H. Alldredge, Peachtree Corners, GA (US)

( * ) Notice: Subject to any disclaimer, the term of this patent is extended or adjusted under 35 U.S.C. 154(b) by 0 days.

(21) Appl. No.: 14/695,342

(22) Filed: Apr. 24, 2015

(65) Prior Publication Data

US 2015/0306453 A1 Oct. 29, 2015

Related U.S. Application Data

(60) Provisional application No. 61/983,596, filed on Apr. 24, 2014.

(51) Int. Cl.
*A63B 23/16* (2006.01)
*A63B 21/00* (2006.01)
*A63B 21/02* (2006.01)

(52) U.S. Cl.
CPC ..... *A63B 23/16* (2013.01); *A63B 21/0004* (2013.01); *A63B 21/025* (2013.01)

(58) Field of Classification Search
CPC ..... A63B 21/0004; A63B 21/00043; A63B 21/00069; A63B 21/00072; A63B 21/00178; A63B 21/00185; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/0445; A63B 21/0455; A63B 21/065; A63B 21/068; A63B 21/0728; A63B 21/4023; A63B 21/4025; A63B 21/4035; A63B 21/4039; A63B 21/4043; A63B 21/4045; A63B 21/4047; A63B 21/4049; A63B 23/14; A63B 23/16
See application file for complete search history.

(56) References Cited

U.S. PATENT DOCUMENTS 69,288 A * 9/1867 Wells et al. ..... F16B 2/16 244/488
437,877 A * 10/1890 Truax ..... A47C 21/022 211/57.1
D31,972 S * 12/1899 Carter ..... 24/550
708,242 A * 9/1902 Moseley ..... A63B 23/16 482/49
871,888 A * 11/1907 Porter ..... D06F 55/00 24/550
1,759,471 A * 5/1930 Tantlinger ..... A63B 65/08 124/44
2,147,963 A * 2/1939 Casciotti ..... B65D 45/32 220/321
2,633,358 A * 3/1953 Wright ..... A63B 23/16 482/49
2,874,430 A * 2/1959 Coldren ..... F16B 2/248 24/27

(Continued)

*Primary Examiner* — Oren Ginsberg
*Assistant Examiner* — Gary D Urbiel Goldner
(74) *Attorney, Agent, or Firm* — Matthew L. Grell; Grell & Watson Patent Attorney

(57) ABSTRACT

A thumb exercise device for simulating the feel and action of backing a hammer of a firearm includes a thumb section, a grip section, and a middle section. The middle section interconnects the thumb section with the grip section. The middle section biases the thumb section away from the grip section. Wherein, when the grip section is held in the user's fingers similar to a grip of the firearm, the thumb section is oriented to approximate a user's extended thumb similar to the hammer of the firearm. Wherein, the user may grip the grip section with their fingers and depress the thumb section with their thumb. Whereby, the thumb exercise device simulates the feel and action of backing the hammer of the firearm.

6 Claims, 6 Drawing Sheets

(56) References Cited

U.S. PATENT DOCUMENTS 3,216,259 A * 11/1965 Bendix, Jr. ..... A63B 23/16 482/49
3,675,275 A * 7/1972 Arblaster ..... A44B 99/00 248/75
4,148,149 A * 4/1979 Pachmayr ..... F41C 23/10 42/71.02
4,569,105 A * 2/1986 Weider ..... A63B 21/0728 24/544
4,623,141 A * 11/1986 Salvino ..... A63B 21/0455 482/127
4,632,384 A * 12/1986 Bright ..... A63B 23/03508 482/49
4,726,580 A * 2/1988 Batiste ..... A63B 21/05 482/122
5,308,299 A * 5/1994 Winston ..... A63B 23/16 482/126
D353,859 S * 12/1994 Grey ..... D21/684
5,472,400 A * 12/1995 Royer ..... A63B 21/00047 482/141
D381,718 S * 7/1997 Armstrong ..... D21/684
D431,060 S * 9/2000 Wyrick ..... D21/679
7,077,787 B1 * 7/2006 Wiesman ..... A63B 21/025 482/127
D591,367 S * 4/2009 Harris ..... D21/684
7,789,814 B1 * 9/2010 Xu ..... A63B 21/0728 482/107
7,794,369 B1 * 9/2010 Rivera, III ..... A63B 5/20 482/81
D633,157 S * 2/2011 Knapp ..... D21/684
8,142,335 B1 * 3/2012 Leach ..... A63B 21/0728 482/107
D694,577 S * 12/2013 Lynn ..... D21/684
8,915,824 B2 * 12/2014 Roberts ..... A63B 23/14 482/49
2007/0167288 A1 * 7/2007 Lin ..... A63B 23/16 482/49
2013/0072359 A1 * 3/2013 Leach ..... A63B 21/0004 482/107
2013/0112184 A1 * 5/2013 Corsiglia ..... F42B 6/00 124/78

* cited by examiner

THUMB EXERCISE DEVICE

CROSS-REFERENCE TO RELATED APPLICATIONS

The application claims benefit to U.S. Provisional Patent Application No. 61/983,596 filed on Apr. 24, 2014, which is incorporated by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

1. Technical Field

The instant disclosure relates to an exercise device and method of use thereof. More particularly, the instant disclosure relates to a thumb exercise device for exercising the thumb, like for conditioning the thumb for cocking back the hammer of a firearm, like a single action revolver for the sport of mounted shooting.

2. Description of the Related Art

In the sport of mounted shooting, it is required to fire blank cartridges from a single action revolver. This requires the part of the gun called a hammer to be pulled backward (i.e. cocking back the hammer) using the thumb to the firing position at a rapid and repeated pace for ten shots. This action also normally occurs with the arm extended at full length and unsupported.

This movement of pulling backward on the hammer by the thumb with the arm extended and unsupported is an unusual and particular motion that is unique to some shooting sports. As such, this movement can require extensive conditioning of the thumb and associated muscles. One problem that has been discovered for many beginning and experienced shooters is cramping in the hand when competing.

The instant disclosure provides a thumb exercise device and method of use thereof that is designed to address at least certain aspects of the problems discussed above.

SUMMARY

Briefly described, in a preferred embodiment, the present apparatus and method overcomes the above-mentioned disadvantages and meets the recognized need for such a device by providing a thumb exercise device and method of use thereof that trains and conditions the thumb and associated muscles for pulling back the hammer of a firearm, like a single action revolver for the sport of mounted shooting.

The present thumb exercise device and method of use thereof may be a hand held device for simulating the feel and action of backing a hammer of a firearm that includes a thumb section, a grip section, and a middle section. The middle section interconnects the thumb section with the grip section. The middle section biases the thumb section away from the grip section. When the grip section is held in the user's fingers similar to a grip of a firearm, the thumb section is oriented approximate the user's extended thumb similar to the hammer of the firearm. Wherein, the user may grip the grip section with their fingers and depress the thumb section with their thumb. Whereby, the thumb exercise device simulates the feel and action of backing the hammer of the firearm.

One feature may be that the thumb exercise device may simulate the feel and action of backing the hammer of the firearm with slightly greater resistance.

In select embodiments, the thumb section may include a surface sized to receive the user's thumb. The surface may be substantially flat and oriented approximately horizontal when the grip section is held in the user's fingers similar to the grip of the firearm. The surface may have a rounded distal end for contact with the user's thumb.

One feature of the thumb section may be that it can include a thumb pad on the surface. In select embodiments, the thumb pad may be plastic or urethane.

Another feature may be that the grip section may include a cover with a shape similar to the grip of the firearm. In select embodiments, the cover may be urethane, rubber, the like, and/or combinations thereof.

Another feature may be that the middle section may include a trigger finger hole sized like a trigger hole of the firearm configured to receive a trigger finger of the user. In select embodiments, the trigger finger hole may include a trigger surface positioned like a trigger of the firearm inside the trigger finger hole. In select embodiments, the trigger surface may be integral with the cover of the grip section.

In select embodiments, the middle section may include a spring coil terminating at one end with the thumb section and at the other end with the grip section.

In select embodiments, the spring coil may include or consist of one coil in the middle section for biasing the thumb section from the grip section.

One feature may be that the thumb section end of the spring coil can include a thumb angle and a thumb loop. The thumb angle may be from the spring coil and may be configured to orient the surface of the thumb section approximately horizontal when the grip section is held in the user's fingers similar to the grip of the firearm. The thumb loop may be after the thumb angle and may be configured for making the surface of the thumb section.

Another feature may be that the grip section end of the spring coil can include a first grip angle, a second grip angle, and a grip loop. The first grip angle and the second grip angle may be configured to orient the grip section from the spring coil. The grip loop may be after the first grip angle and the second grip angle and may be configured to support the grip section including the cover.

In select embodiments, the spring coil may be a steel spring coil.

In select embodiments, the firearm that the thumb exercise device simulates may be a single action revolver.

In use, a method of exercising the thumb may be provided utilizing any of the various embodiments of the thumb exercise device described and/or shown herein. The method of exercising the thumb may generally comprise the steps of: providing the thumb exercise device in any of the various embodiments shown and/or described herein; gripping the grip section with a user's fingers similar to a grip of a firearm; and depressing the thumb section with the user's thumb.

BRIEF DESCRIPTION OF THE DRAWINGS

The present thumb exercise device will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
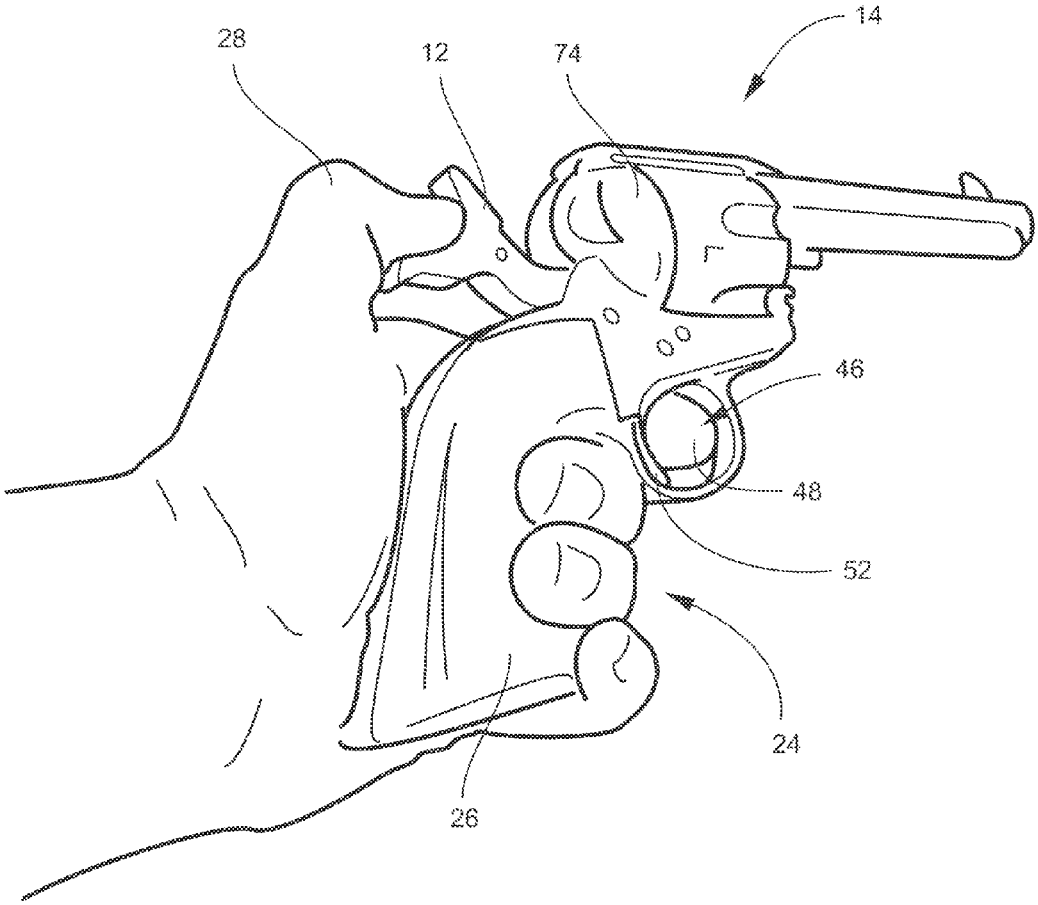
FIG. 1 Prior Art
FIG. 1 is a perspective view of the grip for pulling back the hammer of a firearm according to the prior art.
Figure 2A:
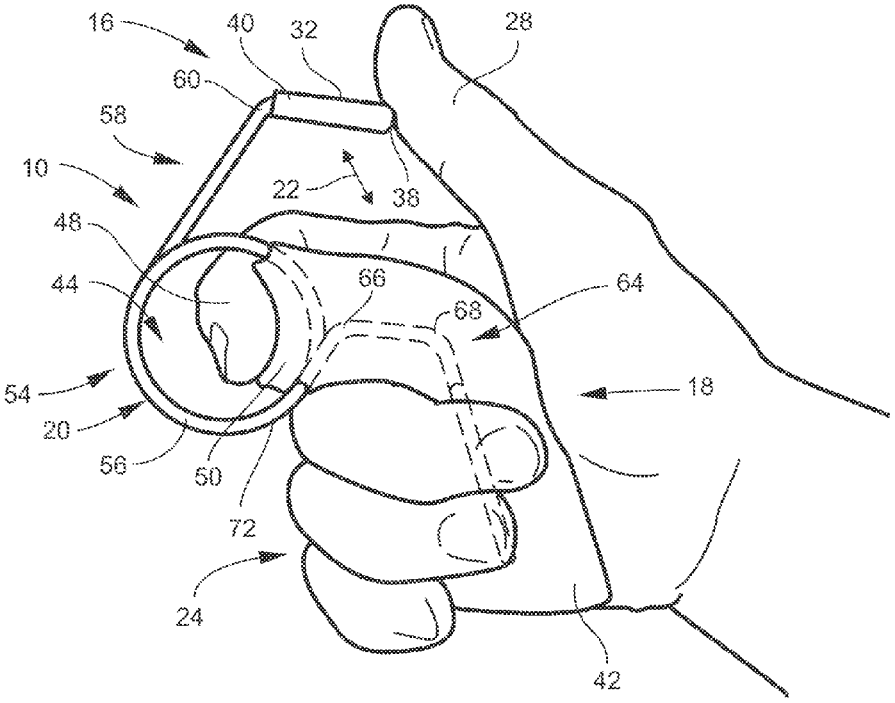
FIG. 2A is a perspective view of an exemplary embodiment of the thumb exercise device with the user's finger's gripping the grip section and the thumb extended to the thumb section prior to depressing.
Figure 2B:
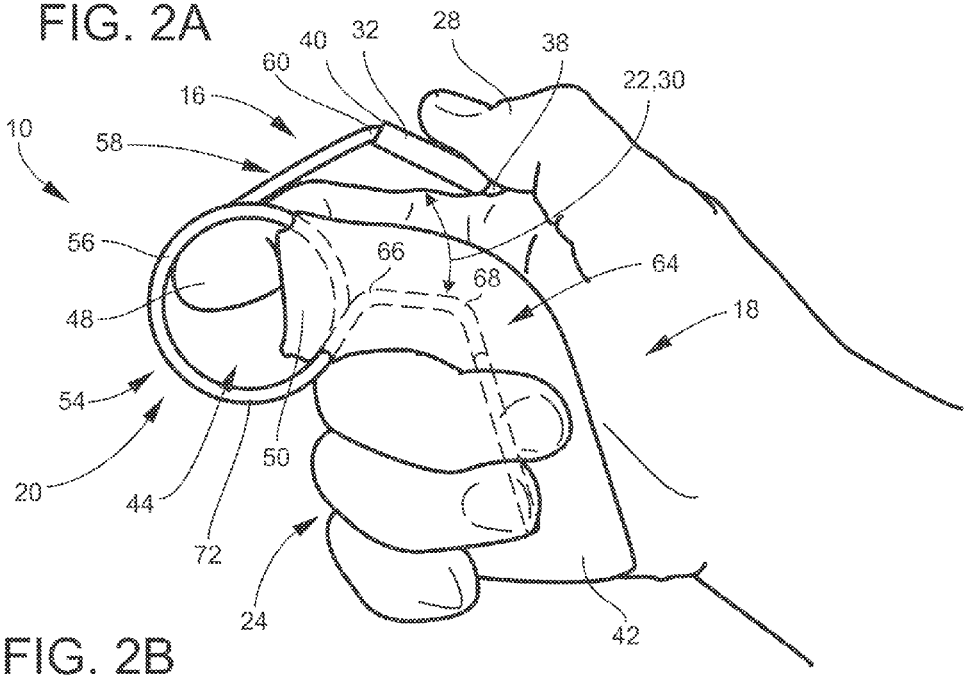
FIG. 2B is a perspective view of the thumb exercise device of FIG. 2A with the user's finger's gripping the grip section and the thumb depressing the thumb section.
Figure 4:
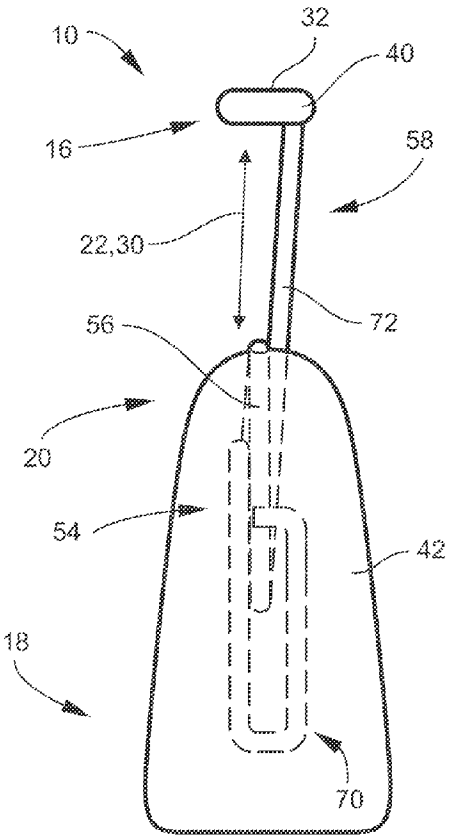
FIG. 4 is a front view of the thumb exercise device of FIG. 2A.

Referring to FIG. 1, a prior art firearm 14 is shown in the form of the single action revolver 74. Firearm 14 has the grip 26, the trigger hole 46 with trigger 52 positioned inside, and the hammer 12. As shown in FIG. 1, in order to cock the hammer 12 or pull back hammer 12, the user grips the grip 26 with their fingers 24, which may include placing the trigger finger 48 inside trigger hole 46 against trigger 52. Once gripped, the user can extend their thumb to reach hammer 12, and cock or pull back hammer 12 with their thumb 28. This movement of pulling backward on the hammer 12 by the thumb 28, which is typically done with the arm extended and unsupported (ten times rapidly for mounted shooting), is an unusual and particular motion. As such, this movement can require extensive conditioning of the thumb 28 and associated muscles to reduce and/or prevent all together cramping in the hand when competing.

The present thumb exercise device 10 may be a hand held device that may simulate the near feel and action of backing the hammer 12, (i.e. pulling back the hammer 12) of the firearm 14 with possibly slightly greater resistance. A hand held device may refer to a device that may be held in the hand similar to the firearm 14 and may have any desire dimensions that can be held in the hand, including, but not limited to, approximately 3.5 inches by 4.5 inches. As an example, and clearly not limited thereto, the purpose of the thumb exercise device 10 may be to allow one to train for strength and flexibility on the motion required for the sport of mounted shooting and to be able to do so in places that practicing with the firearm 14 would be impractical or possibly illegal. As such, the thumb exercise device 10 may be for simulating the feel and action of backing the hammer 12 of the firearm 14. However, the disclosure is clearly not limited thereto, and can be used for any purpose of exercising the thumb 28.

Referring now to FIGS. 2-8 by way of example, and not limitation, therein is illustrated example embodiments of thumb exercise device 10. Thumb exercise device 10 may generally include the thumb section 16, the grip section 18, and the middle section 20. The middle section 20 may interconnect the thumb section 16 with the grip section 18. The middle section 20 may bias the thumb section 16 away from the grip section 18, as generally shown with direction arrow 22 (see FIGS. 2-6). When the grip section 18 is held in the user's fingers 24 similar to the grip 26 of the firearm 14 (as shown in FIG. 1), the thumb section 16 may be oriented approximate the user's extended thumb 28 similar to the hammer 12 of the firearm 14 (as shown in FIG. 1). Wherein, the user may grip the grip section 18 with their fingers 24 and depress the thumb section 16 with their thumb 28. Whereby, the thumb exercise device 10 may simulate the feel and action of backing the hammer 12 of the firearm 14, like the single action revolver 74.

Thumb exercise device 10 may be designed and/or configured to provide any desired resistance of depressing thumb section 16. In select embodiments, the thumb exercise device 10 may simulate the feel and action of backing the hammer 12 of the firearm 14. In other select embodiments, the thumb exercise device 10 may simulate the feel and action of backing the hammer 12 of the firearm 14. with slightly greater resistance 30.

The thumb section 16 may include the surface 32 sized to receive the user's thumb 28. Surface 32 may be configured in any desired size, shape, and/or orientation. In select embodiments, the surface 32 may be substantially flat and oriented approximately horizontal when the grip section 18 is held in the user's fingers 24 similar to the grip 26 of the firearm 14 (like in FIG. 1). In other select embodiments, the surface 32 may have the rounded distal end 38. Rounded distal end 38 may be for providing comfort for contact with the user's thumb 28. In other select embodiments, the thumb section 16 may include the thumb pad 40 positioned on the surface 32. Thumb pad 40 may be for providing a contact material for the user's thumb 28. Thumb pad 40 may be made from any desired material for contacting the user's thumb 28. In select embodiments, the thumb pad 40 may be plastic. In other select embodiments, the thumb pad 40 may be urethane, including being molded or created out of the same material as the cover 42.

Figure 3:
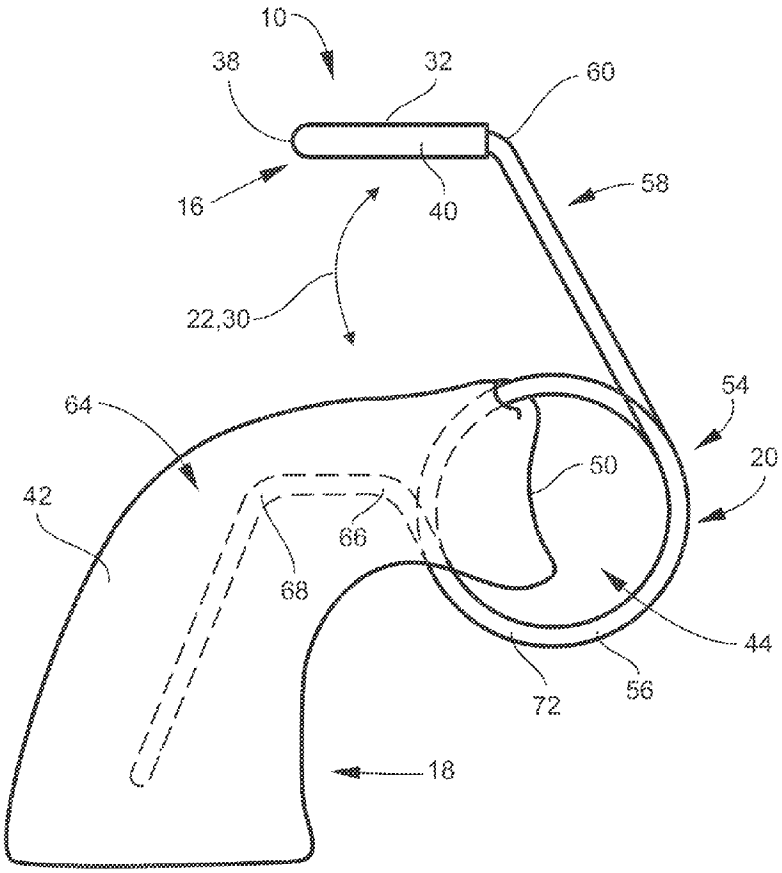
FIG. 3 is a side view of the thumb exercise device of FIG. 2A.
Figure 5:
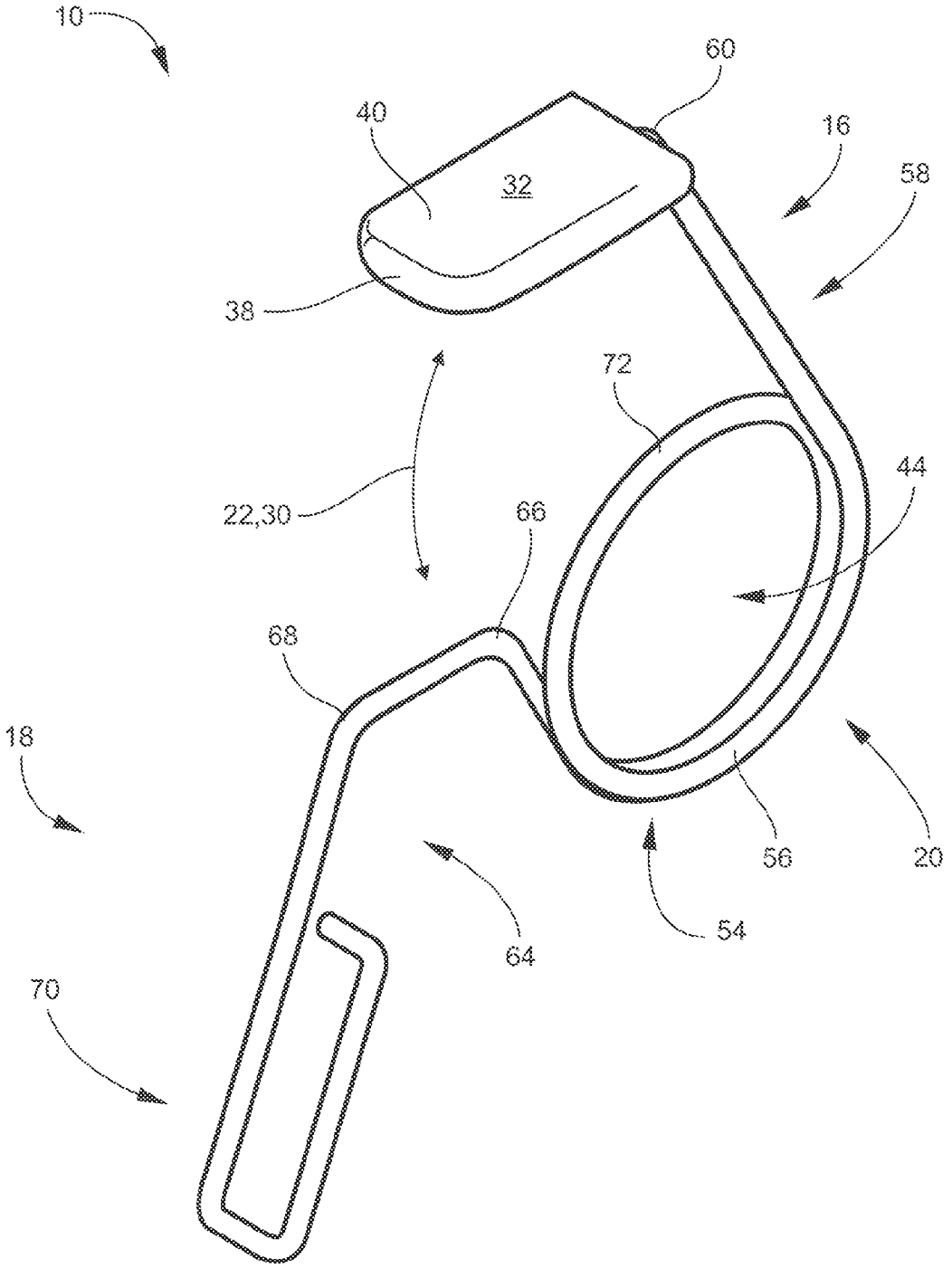
FIG. 5 is a perspective view of another exemplary embodiment of the thumb exercise device.

Referring to FIGS. 2-3, the cover 42 may be included with grip section 18. The cover 42 may have a shape similar to the grip 26 of the firearm 14 (see FIG. 1). The cover 42 may be designed to replicate various firearms or other desired shapes. Additionally, cover 42 may be made from any desired material, including similar materials to various firearms or other desired devices. In select embodiments, the cover 42 may be made from urethane, rubber, the like, and/or combinations thereof. In select embodiments, the cover 42 may be urethane, including being molded or created out of the same material as the thumb pad 40.

The middle section 20 may include the trigger finger hole 44. The trigger finger hole 44 may be sized like the trigger hole 46 of the firearm 14. The trigger finger hole 44 may be configured to receive the trigger finger 48 of the user. In select embodiments, the trigger finger hole 44 may include the trigger surface 50. The trigger surface 50 may be positioned like the trigger 52 of the firearm 14 inside the trigger finger hole 44 (see FIG. 1). In select embodiments, the trigger surface 50 may be integral with the cover 42 of the grip section 18, i.e. the cover 42 extends into the trigger finger hole 44 to create trigger surface 50, as shown in FIGS. 2-3.

The spring coil 54 may be included in select embodiments of middle section 20. See FIGS. 2-8. The spring coil 54 may be for biasing thumb section 16 from grip section 18. The spring coil 54 may terminate at one end 58 with the thumb section 16 and at the other end 64 with the grip section 18. Spring coil 54 may be any desired size and/or strength for biasing thumb section 16 from grip section 18. In select embodiments, the spring coil 54 may include or consist of one coil 56 in the middle section 20 for biasing the thumb section 16 from the grip section 18. The spring coil 54 may create trigger finger hole 44. In select embodiments, the spring coil 54 may be the steel spring coil 72.

Figure 7:
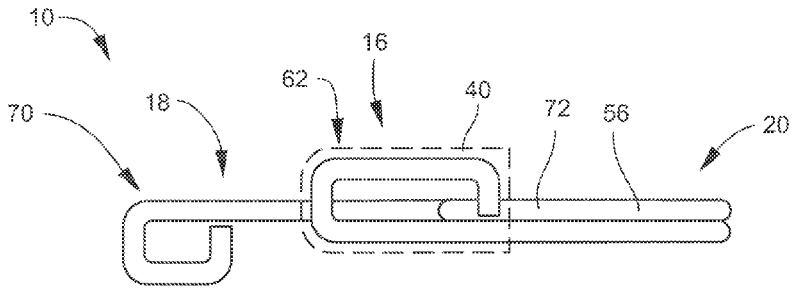
FIG. 7 is a top view of the thumb exercise device of FIG. 5.
Figure 8:
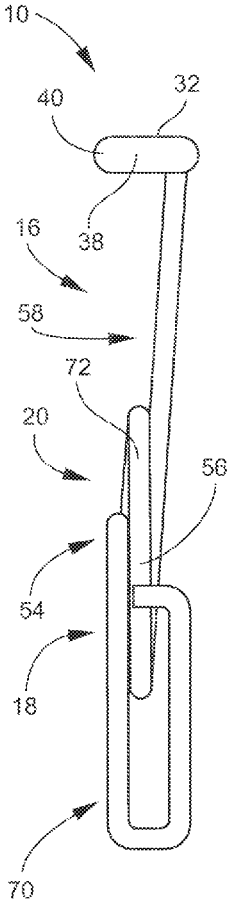
FIG. 8 is a front view of the thumb exercise device of FIG. 5.
Figure 6:
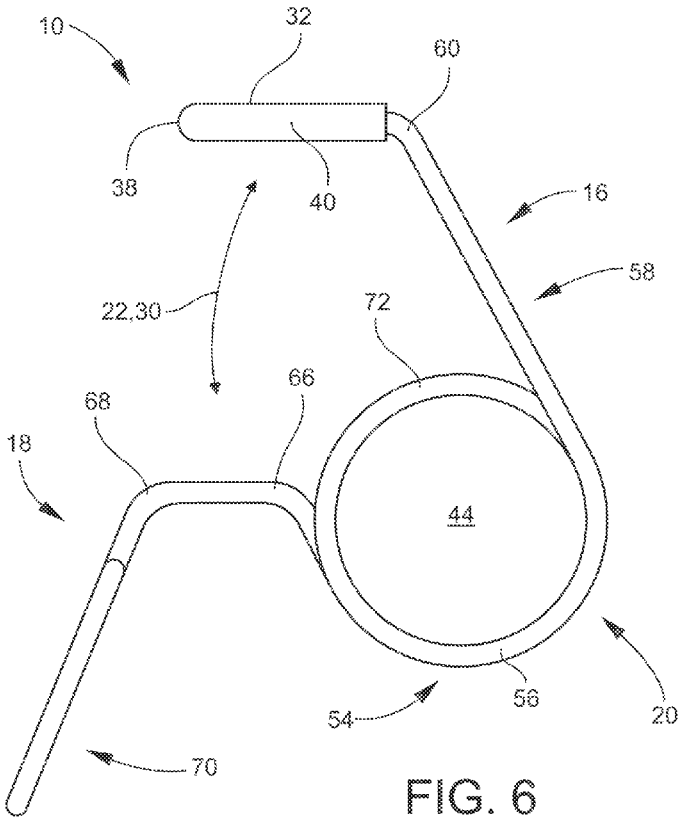
FIG. 6 is a side view of the thumb exercise device of FIG. 5.

In select embodiments, the thumb section end 58 of the spring coil 54 can include the thumb angle 60 and/or the thumb loop 62 (see FIG. 7). The thumb angle 60 may be configured to orient the surface 32 of the thumb section 16 approximately horizontal when the grip section 18 is held in the user's fingers 24 similar to the grip 26 of the firearm 14 (see FIG. 1). The thumb angle 60 may be an angle from the spring coil 54. The thumb loop 62 may be after the thumb angle 60 and may be configured for making or supporting the surface 32 of the thumb section 16.

In select embodiments, the grip section end 64 of the spring coil can include the first grip angle 66, the second grip angle 68, and/or the grip loop 70. The first grip angle 66 and the second grip angle 68 may be configured to orient the grip from the spring coil 54. The grip loop 70 may be after the first grip angle 66 and/or the second grip angle 68 and may be configured to support the grip section 18.

Figure 9:
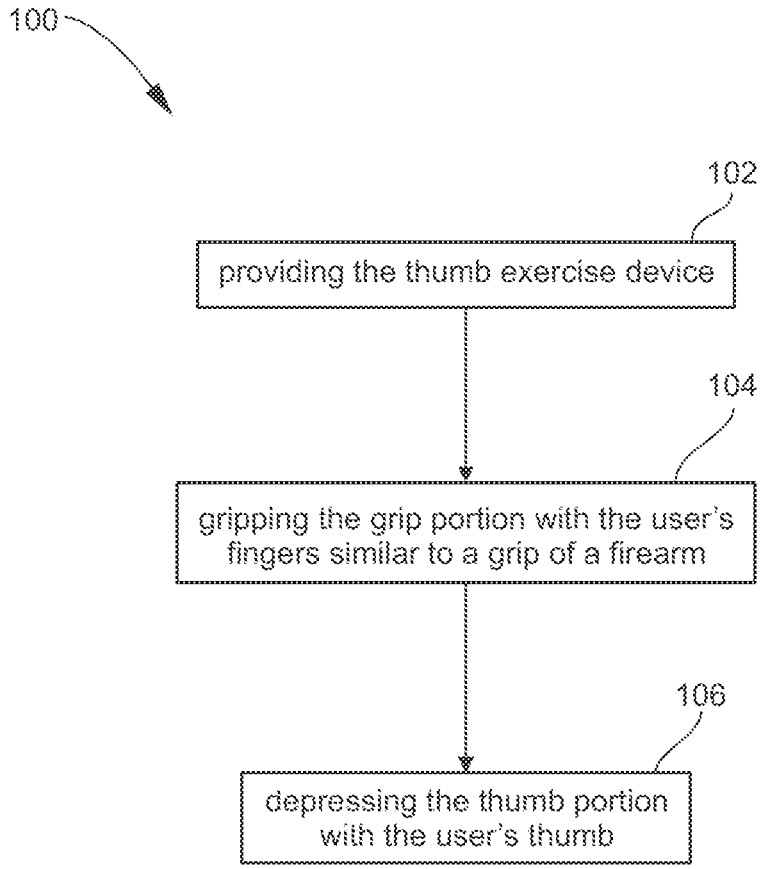
FIG. 9 is a flow diagram of an exemplary embodiment of the method of exercising the thumb.

Referring now to FIG. 9, in use, the method 100 of exercising the thumb 28 may be provided utilizing any of the various embodiments of the thumb exercise device 10 described and/or shown herein. The method 100 of exercising the thumb 28 may generally comprise the steps of: the step 102 of providing the thumb exercise device 10 in any of the various embodiments shown and/or described herein; the step 104 of gripping the grip section 18 with the user's fingers 24 similar to the grip 26 of the firearm (see FIG. 2A); and the step 106 of depressing the thumb section 16 with the user's thumb 28 (see FIG. 2B).

EXAMPLE

An example thumb exercise device 10 was constructed from the steel spring coil 72 with the single coil 56 forming the trigger finger hole 44 with a diameter of approximately 1.5 inches. At one distal end of the steel spring coil 72, the steel wire was extended out to form thumb section 16. The steel wire was extended at an angle above the spring coil 72 to create surface 32 of thumb section 16 approximately 1.25 inches above the spring coil 54, where the surface was approximately horizontal when held by the user. The surface 32 of thumb section 16 was created with a length of approximately 1 inch, which was created by the end of the wire being bent into an approximately rectangular loop creating thumb loop 62 with approximate dimensions of 1 inch by 0.5 inches. A urethane thumb pad 40 was inserted over thumb loop 62. The other end of the steel wire was extended out and curved to form grip section 18. The steel was bent at its distal end into an approximately rectangular loop creating grip loop 70 with approximate dimensions of 1.75 inches by 0.5 inches. From the curved portion extending from the coil 54 to the bottom of the grip section 18, the distance was approximately 2 inches. From this same curved portion to the surface 32 of thumb section 16 was approximately 2 inches. This gave the overall dimension of the steel wire spring coil approximately 3.25 inches by 4.25 inches. The grip loop 70 was covered with the urethane cover 42 sized and shaped like grip 26 of single action revolver 74 including trigger surface 50 extending into trigger finger hole 44.

The result of the constructed thumb exercise device 10 created a hand held device that simulated the cocking of the hammer 12 of the single action revolver 74 with a greater resistance.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A thumb exercise device for simulating a feel and action of backing a hammer of a firearm comprising:

a spring coil comprising:

a single coil terminating at one end with a thumb section and at another end with a grip section, said single coil biasing said thumb section end from said grip section end;

the thumb section end includes a surface sized to receive a thumb of a user, wherein the surface is substantially flat and oriented approximately horizontal when the grip section end is held by the user in a manner simulating the user holding a grip of the firearm, the surface has a thumb pad with a rounded distal end for contact with the thumb of the user, the thumb section end of the spring coil includes:

a thumb angle from the spring coil configured to orient the surface of the thumb section end approximately horizontal when the grip section end is held by the user in the manner simulating the user holding the grip of the firearm; and a thumb loop after the thumb angle configured for making the surface of the thumb section end;

the grip section end includes a cover with a shape similar to the grip of the firearm, the grip section end of the spring coil includes:

a first grip angle and a second grip angle from the spring coil configured to orient the grip section end for being held by the user in the manner simulating the user holding the grip of the firearm; and a grip loop after the first grip angle and second grip angle configured to support the cover;

the spring coil forms a trigger finger hole in its middle sized like a trigger hole of the firearm configured to receive a trigger finger of the user, the cover from the grip section end extends around and into a portion of the trigger finger hole formed by the spring coil to form a trigger surface that is positioned like a trigger of the firearm inside the trigger hole, where the trigger surface is integral with the cover of the grip section end;

wherein when the grip section end is held in fingers of the user in the manner simulating the user holding the grip of the firearm, said thumb section end is configured to be oriented to approximate an extended position of the thumb of the user in a manner simulating use of the hammer of the firearm by the user;

wherein, the user may grip the grip section end with the fingers of the user and depress the thumb section end with the thumb of the user;

whereby, the thumb exercise device simulates the feel and action of backing the hammer of the firearm.

2. The thumb exercise device of claim 1, wherein the thumb exercise device is configured to simulate a slightly greater resistance than a resistance encountered when backing the hammer of the firearm.

3. The thumb exercise device of claim 1, wherein said thumb pad is plastic or urethane.

4. The thumb exercise device of claim 1, wherein the cover is urethane or rubber.

5. The thumb exercise device of claim 1 wherein the spring coil is a steel spring coil.

6. A method of exercising the thumb comprising:

providing a thumb exercise device for simulating a feel and action of backing a hammer of a firearm comprising:

a spring coil comprising:

a single coil terminating at one end with a thumb section and at another end with a grip section, said single coil biasing said thumb section end from said grip section end;

the thumb section end includes a surface sized to receive a thumb of a user, wherein the surface is substantially flat and oriented approximately horizontal when the grip section end is held by the user in a manner simulating the user holding a grip of the firearm, the surface has a thumb pad with a rounded distal end for contact with the thumb of the user, the thumb section end of the spring coil includes:

a thumb angle from the spring coil configured to orient the surface of the thumb section end approximately horizontal when the grip section end is held by the user in the manner simulating the user holding the grip of the firearm; and a thumb loop after the thumb angle configured for making the surface of the thumb section end;

the grip section end includes a cover with a shape similar to the grip of the firearm, the grip section end of the spring coil includes:

a first grip angle and a second grip angle from the spring coil configured to orient the grip section end for being held by the user in the manner simulating the user holding the grip of the firearm; and a grip loop after the first grip angle and second grip angle configured to support the cover;

the spring coil forms a trigger finger hole in its middle sized like a trigger hole of the firearm configured to receive a trigger finger of the user, the cover from the grip section end extends around and into a portion of the trigger finger hole formed by the spring coil to form a trigger surface that is positioned like a trigger of the firearm inside the trigger hole, where the trigger surface is integral with the cover of the grip section end;

gripping the grip section end with fingers of the user in the manner simulating the user holding the grip of the firearm, wherein when said grip section end is held in the fingers of the user in the manner simulating the user holding the grip of the firearm, said thumb section end is configured to be oriented to approximate an extended position of the thumb of the user in a manner simulating use of the hammer of the firearm by the user; and depressing the thumb section end with the thumb of the user, whereby, the thumb exercise device simulates the feel and action of backing the hammer of the firearm.

* * * * *